United States Patent [19]

Arumugham

[11] 4,290,005

[45] Sep. 15, 1981

[54] COMPENSATED REFERENCE VOLTAGE SOURCE

[75] Inventor: Rangaswamy Arumugham, Acton, Mass.

[73] Assignee: GTE Laboratories Incorporated, Waltham, Mass.

[21] Appl. No.: 166,526

[22] Filed: Jul. 7, 1980

[51] Int. Cl.[3] ..... G05F 3/20

[52] U.S. Cl. ..... 323/313; 323/231; 307/297; 307/318

[58] Field of Search ..... 323/231, 303, 313, 315; 307/296 R, 297, 318

[56] References Cited

U.S. PATENT DOCUMENTS

| | | | |
|---|---|---|---|
| 3,522,521 | 8/1970 | Lloyd | 323/313 |
| 3,829,717 | 8/1974 | Harrison | 323/231 X |
| 4,063,147 | 12/1977 | Hatanaka et al. | 323/313 |

*Primary Examiner*—William M. Shoop
*Assistant Examiner*—Peter S. Wong
*Attorney, Agent, or Firm*—David M. Keay

[57] ABSTRACT

A compensated reference voltage source for providing a stable output voltage despite variations in operating voltage. The circuitry includes a series arrangement of a first resistance, a Zener diode, and a second resistance connected between a source of operating voltage and ground. A first transistor has its collector connected to the juncture of the first resistance and the Zener diode, its base connected to the juncture of the Zener diode and the second resistance, and its emitter connected to ground. A second transistor has its base and emitter connected directly to the corresponding electrodes of the first transistor and its collector connected to an output terminal. A third transistor has its collector connected to the source of operating voltage, its emitter connected to the output terminal, and its base connected to the collector of the first transistor. The base-emitter characteristics of the transistors are essentially identical. The voltage across the Zener diode remains constant despite variations in the operating voltage. However, the voltage at the collector of the first transistor varies because of changes in current flow across its base-emitter junction. Because of the interconnections, equal currents flow through each of the transistors. Since the base-emitter characteristics of the transistors are identical, the voltage drops across the base-emitter junctions of the first and third transistors are equal. Thus, the voltage at the output terminal is equal to the voltage across the Zener diode and remains constant despite variations in the operating voltage.

13 Claims, 3 Drawing Figures

COMPENSATED REFERENCE VOLTAGE SOURCE

BACKGROUND OF THE INVENTION

This invention relates to reference voltage sources. More particularly, it is concerned with sources of reference voltage providing compensation for variations in operating voltage.

Television receivers employing tuner circuitry which utilize voltage controlled oscillators require stable sources of reference voltage. In some instances relatively simple voltage sources employing Zener diodes to maintain the voltage constant are employed. However, voltages produced by these sources vary to some extent with applied operating voltage. In addition, the output level may vary when a heavy output current is drawn. Reference voltage sources are available which provide more stable operation. However, these sources contain relatively complex circuitry and are generally considered too expensive for use in television receivers.

SUMMARY OF THE INVENTION

A reference voltage which remains fairly constant over a range of applied operating voltages is provided by the compensated reference voltage source in accordance with the present invention. In addition, the source is simple and inexpensive and is amenable to fabrication in a monolithic integrated circuit. A compensated reference voltage source in accordance with the invention includes a first resistance means, a constant voltage means, such as a Zener diode, and a second resistance means connected in series between a source of operating voltage and a point of fixed potential. The collector electrode of a first transistor is connected to the juncture of the first resistance means and the constant voltage means. The base electrode of the first transistor is connected to the juncture of the constant voltage means and the second resistance means, and the emitter electrode is connected to the point of fixed potential. Changes in the voltage of the source of voltage change the current through the first transistor. Consequently the base-to-emitter voltage of the first transistor changes thereby altering the potential at the collector electrode of the first transistor. A second transistor has its base electrode connected to the base electrode of the first transistor and its emitter electrode connected to the emitter electrode of the first transistor. Thus, the base-to-emitter voltage of the second transistor is equal to the base-to-emitter voltage of the first transistor. The collector electrode of the second transistor is connected to an output terminal. The collector electrode of a third transistor is connected to the source of voltage and its emitter electrode is connected to the output terminal. The base electrode of the third transistor is connected to the collector electrode of the first transistor. Thus, the voltage at the output terminal is related to the voltage at the collector electrode of the first transistor and the base-to-emitter voltage of the third transistor.

For a better understanding of the present invention, together with other and further objects, advantages, and capabilities thereof, reference is made to the following discussion and appended claims in connection with the above-described drawings.

DETAILED DESCRIPTION OF THE INVENTION

Figure 1:
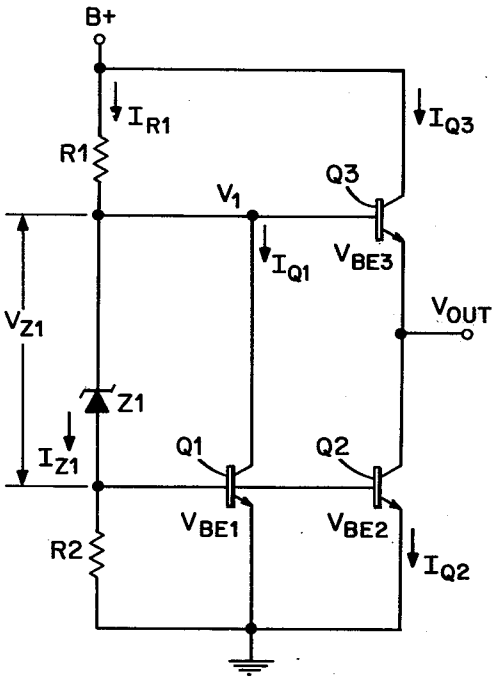
FIG. 1 is a circuit diagram of a compensated reference voltage source in accordance with the present invention.

FIG. 1 is a circuit diagram illustrating a compensated reference voltage source in accordance with the present invention. In the circuit a first resistance R1, a Zener diode Z1, and a second resistance R2 are connected in series between a source of B+ operating voltage and ground. A first bipolar NPN transistor Q1 has its collector connected to the juncture of the first resistance R1 and one terminal of the Zener diode Z1 and its emitter connected to ground. The base of transistor Q1 is connected directly to the juncture of the other terminal of Zener diode Z1 and the resistance R2. A second bipolar NPN transistor Q2 has its base connected directly to the base of the first transistor Q1 and its emitter connected directly to the emitter of the first transistor Q1 and also to ground. The collector of the second transistor Q2 is connected to an output terminal $V_{OUT}$. A third bipolar NPN transistor Q3 has its collector connected directly to the B+ voltage source, its base connected directly to the collector of transistor Q1 and its emitter connected directly to the collector of the second transistor Q2.

In the circuit as illustrated in order to provide precise compensation as will be explained hereinbelow, the three transistors Q1, Q2, and Q3 are essentially the same. In particular, the base-emitter characteristics of the transistors are essentially identical. Identical characteristics are more readily obtained when the devices are fabricated simultaneously in a monolithic integrated circuit. All of the transistors have relatively high beta, or amplification factor.

As is well understood the voltage drop $V_{21}$ across the Zener diode Z1 is relatively constant over a wide range of current through the Zener diode. Thus despite variations in the B+ operating voltage, the voltage $V_{Z1}$ across the diode tends to remain fairly constant. The current $I_{Z1}$ through the Zener diode Z1 may be considered essentially equal to that through the second resistance R2 and is determined by the base-to-emitter voltage $V_{BE1}$ of the first transistor Q1 and the second resistance R2.

$$V_{BE1}/R2=I_{Z1} \quad (1)$$

The current flow $I_{R1}$ from the B+ voltage source flows through the resistance R1. That current splits into $I_{Z1}$ which flows through the Zener diode Z1 and the second resistance R2 and $I_{Q1}$ which flows through the first transistor Q1.

$$I_{R1}=I_{Q1}+I_{Z1} \quad (2)$$

Changes in current $I_{Q1}$ flowing through the tranistor Q1 due to variations in the B+ operating voltage produce changes in the base-to-emitter voltage $V_{BE1}$ in accordance with the well-known equation $\Delta V_{BE}=26\ln(I_1$.

/$I_2$) millivolts. Therefore, the voltage $V_1$ at the collector of transistor Q1 also changes, because $$V_1 = V_{Z1} + V_{BE1} \quad (3)$$

In the circuit the two additional transistors Q2 and Q3 produce a differential between the voltage $V_1$ at the collector of transistor Q1 and the voltage at the output terminal $V_{OUT}$ so as to compensate for changes in the base-to-emitter voltage drop in transistor Q1. Since the base and emitter of the second transistor Q2 are directly connected to the corresponding electrodes of the first transistor Q1 and since their base-emitter characteristics are essentially identical, current flow through the second transistor Q2 is the same as that through the first transistor Q1. Further, since the third transistor Q3 is connected in series with the second transistor Q2, current through the third transistor Q3 is the same as that through the second transistor Q2.

$$I_{Q1} = I_{Q2} = I_{Q3} \quad (4)$$

Therefore, the base-to-emitter voltage drop of each of the transistors is the same.

$$V_{BE1} = V_{BE2} = V_{BE3} \quad (5)$$

The voltage at the output terminal $V_{OUT}$ is equal to the voltage $V_1$ at the collector of the first transistor Q1 minus the base-to-emitter voltage drop $V_{BE3}$ of the third transistor Q3.

$$V_{OUT} = V_1 - V_{BE3} \quad (6)$$

Since the voltage $V_1$ to the collector of the first transistor Q1 is equal to the voltage $V_{Z1}$ across the Zener diode Z1 plus the base-to-emitter voltage $V_{BE1}$ of the first transistor Q1, the voltage at the output terminal $V_{OUT}$ is equal to the voltage $V_{Z1}$ across the Zener diode Z1.

$$V_{OUT} = V_{Z1} + V_{BE1} - V_{BE3} \quad (7)$$

$$V_{OUT} = V_{Z1} \quad (8)$$

Thus the voltage at the output terminal $V_{OUT}$ remains constant over variations in the B+ operating voltage within the range of the Zener diode producing a constant output voltage. In addition, the arrangement of the output transistors Q2 and Q3 permits a load current to be drawn at the output $V_{OUT}$ without adversely affecting current flow through the Zener diode and thus the capability of the circuitry to provide a properly compensated output voltage. Therefore, it can be seen that the circuitry as shown provides an improved compensated reference voltage source.

Figure 2:
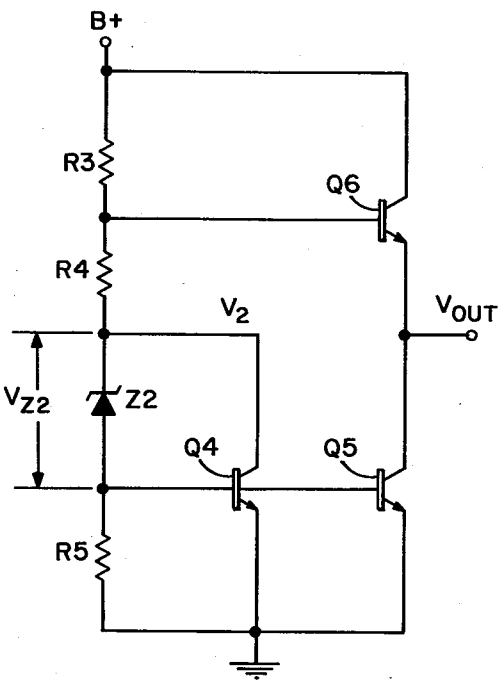
FIG. 2 is a circuit diagram of a modification of the reference voltage source of FIG. 1 in which the output voltage varies in the same direction of polarity with variations in the applied operating voltage.

FIG. 2 is a circuit diagram of a modification of the the reference voltage source of FIG. 1. The function of the modified version is to provide some change in output voltage $V_{OUT}$ which is proportional to changes in the B+ operating voltage. The circuit arrangement of FIG. 2 includes a series arrangement of a first resistance R3, a second resistance R4, a Zener diode Z2, and a third resistance R5 between the B+ voltage source and ground. A first transistor Q4 has its collector connected directly to one terminal of the Zener diode Z2, its base connected to the other terminal of the Zener diode Z2, and its emitter connected directly to ground. A second transistor Q4 has its base and emitter connected directly to the corresponding electrodes of the first transistor Q4 and its collector connected to the output voltage $V_{OUT}$. A third transistor Q6 has its collector connected to the B+ operating source and its emitter connected to the collector of the second transistor Q5. Its base is connected to the juncture of resistances R3 and R4. The three transistors are essentially identical and, therefore, their base-emitter voltages are equal and the currents flowing through them are equal.

Since the base-emitter voltages across the first transistor Q4 and the third transistor Q6 are equal for the reasons explained hereinabove with respect to the circuit of FIG. 1, the output voltage $V_{OUT}$ is equal to the voltage $V_{Z2}$ across the Zener diode Z2 plus the voltage drop across resistance R4. This voltage drop is equal to the resistance R4 times the current flow therethrough, and the current is equal to the difference between the B+ voltage source and the voltage $V_2$ at the collector of the first transistor Q4 divided by the sum of resistances R3 and R4.

$$V_{OUT} = V_{Z2} + \left(\frac{B+ - V_2}{R3 + R4}\right) R4 \quad (9)$$

A change in the voltage of the B+ voltage source ($B+_{(2)} - B+_{(1)}$) thus produces a proportional change $\Delta V_{OUT(2-1)}$ in the output voltage in the same direction of polarity.

$$\Delta V_{OUT(2-1)} = V_{OUT(2)} - V_{OUT(1)} = \left[V_{Z2} + \left(\frac{B+_{(2)} - V_2}{R3 + R4}\right) R4\right] - \left[V_{Z2} + \left(\frac{B+_{(1)} - V_2}{R3 + R4}\right) R4\right] \quad (10)$$

or $$V_{OUT(2-1)} = \frac{B+_{(2)} - B+_{(1)}}{1 + \frac{R3}{R4}} \quad (11)$$

Thus, by appropriate selection of the additional resistance R4 a predetermined change in the output voltage is obtained for a predetermined change in the operating voltage.

Figure 3:
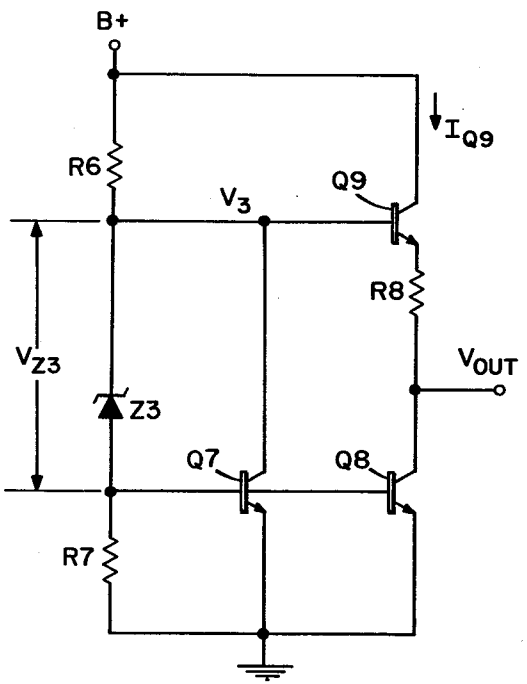
FIG. 3 is a circuit diagram of another modification of the reference voltage source of FIG. 1 in which the output voltage varies in the opposite direction of polarity with variations in the applied operating voltage.

FIG. 3 is a circuit diagram of another modification of the reference voltage source of FIG. 1. In the circuit of FIG. 3 a change in the B+ voltage produces a change in the opposite direction of polarity in the output voltage $V_{OUT}$. The circuit includes a series arrangement of a first resistance R6, a Zener diode Z3, and a second resistance R7 between the B+ voltage source and ground. A first transistor Q7 has its collector connected to the juncture between the resistance R6 and one terminal of the Zener diode Z3, its base connected to the juncture of the other terminal of the Zener diode Z3 and the second resistance R7, and its emitter connected directly to ground. A second transistor Q8 has its base and emitter connected directly to the corresponding electrodes of the first transistor Q7 and its collector connected to the output terminal $V_{OUT}$. A third transistor Q9 has its base connected directly to the collector of the first transistor Q7 and its collector connected directly to the B+ voltage source. Its emitter is connected through a third resistance R8 to the collector of the second transistor Q8 and to the output terminal.

Since, as in the previous embodiments, the base-emitter characteristics are the same for all three transistors, the voltage at the output terminal $V_{OUT}$ equals the voltage $V_{Z3}$ across the Zener diode Z3 minus the voltage drop across resistance R8.

$$V_{OUT}=V_{Z3}-I_{Q9}R8 \quad (12)$$

The current $I_{Q9}$ through transistor Q9 and through resistance R8 is equal to the voltage across resistance R8 divided by resistance R8.

$$V_{OUT} = V_{Z3} - \left(\frac{B+ - V_3}{R6} - \frac{V_{BE}}{R7}\right) R8 \quad (13)$$

A change in the voltage of the B+ voltage source $(B+_{(2)}-B+_{(1)})$ thus produces a change in the opposite direction $\Delta V_{OUT(2-1)}$ in the output voltage.

$$V_{OUT(2-1)} = V_{OUT(2)} - V_{OUT(1)} = \left[V_{Z3} - \left(\frac{B+_{(2)}}{R6} - \frac{V_3}{R6} - \frac{V_{BE}}{R7}\right) R8\right] - \left[V_{Z3} - \left(\frac{B+_{(1)}}{R6} - \frac{V_3}{R6} - \frac{V_{BE}}{R7}\right) R8\right] \quad (14)$$

or $$\Delta V_{OUT(2-1)} = \frac{R8}{R6}(B+_{(1)} - B+_{(2)}) \quad (15)$$

Thus, by appropriate selection of the additional resistance R8 for a predetermined change in the output voltage is obtained for a predetermined change in the operating voltage.

While there has been shown and described what are considered to be preferred embodiments of the present invention, it will be obvious to those skilled in the art that various changes and modifications may be made therein without departing from the invention as defined by the appended claims.

What is claimed is:

1. A compensated reference voltage source comprising in combination a first resistance means, a constant voltage means, and a second resistance means connected in series between a source of voltage and a point of fixed potential;

a first transistor having its collector electrode connected to the juncture of the first resistance means and the constant voltage means, its base electrode connected to the juncture of the constant voltage means and the second resistance means, and its emitter electrode connected to the point of fixed potential whereby changes in the voltage of the source of voltage change the current through the first transistor and consequently the base-to-emitter voltage and the collector electrode voltage of the first transistor;

a second transistor having its base electrode connected to the base electrode of the first transistor, its emitter electrode connected to the emitter electrode of the first transistor whereby the base-to-emitter voltage of the second transistor is equal to the base-to-emitter voltage of the first transistor, and having its collector electrode connected to an output terminal; and a third transistor having its collector electrode connected to the source of voltage, its emitter electrode connected to the output terminal, and its base electrode connected to the collector electrode of the first transistor whereby the voltage at the output terminal is related to the voltage at the collector electrode of the first transistor and the base-to-emitter voltage of the third transistor.

2. A compensated reference voltage source in accordance with claim 1 wherein the base electrodes of the first and second transistors are connected directly to each other; and the emitter electrodes of the first and second transistors are connected directly to each other.

3. A compensated reference voltage source in accordance with claim 2 wherein the base-emitter characteristics of the first, second, and third transistors are essentially identical.

4. A compensated reference voltage source in accordance with claim 3 wherein the constant voltage means includes a Zener diode; and the collector electrode of the first transistor is connected directly to one terminal of the Zener diode and the base electrode of the first transistor is connected directly to the other terminal of the Zener diode.

5. A compensated reference voltage source in accordance with claim 1 wherein the collector electrode of the first transistor is connected directly to a first terminal of the constant voltage means and the base electrode of the first transistor is connected directly to a second terminal of the constant voltage means; and the collector electrode of the third transistor is connected directly to the source of voltage and the base electrode of the third transistor is connected directly to the collector electrode of the first transistor.

6. A compensated reference voltage source in accordance with claim 5 wherein the base electrode of the second transistor is connected directly to the base electrode of the first transistor and the collector electrode of the second transistor is connected directly to the emitter electrode of the third transistor; and the emitter electrode of the first and second transistors are connected directly to each other and to the point of fixed potential.

7. A compensated reference voltage source in accordance with claim 6 wherein the constant voltage means includes a Zener diode connected across the collector and base electrodes of the first transistor; and the base-emitter characteristics of the first, second, and third transistors are essentially identical.

8. A compensated reference voltage source in accordance with claim 1 wherein the first resistance means includes first and second resistance elements connected in series between the source of voltage and a first terminal of the constant voltage means;

the collector electrode of the first transistor is connected directly to the first terminal of the constant voltage means and the base electrode of the first transistor is connected directly to a second terminal of the constant voltage means; and the collector electrode of the third transistor is connected directly to the source of voltage and the base electrode of the third transistor is connected directly to the juncture of the first and second resistance elements.

9. A compensated reference voltage source in accordance with claim 8 wherein the base electrode of the second transistor is connected directly to the base electrode of the first transistor and the collector electrode of the second transistor is connected directly to the emitter electrode of the third transistor; and the emitter electrodes of the first and second transistors are connected directly to each other and to the point of fixed potential.

10. A compensated reference voltage source in accordance with claim 9 wherein the constant voltage means includes a Zener diode; and the base-emitter characteristics of the first, second, and third transistors are essentially identical.

11. A compensated reference voltage source in accordance with claim 1 wherein the collector electrode of the first transistor is connected directly to a first terminal of the constant voltage means and the base electrode of the first transistor is connected directly to a second terminal of the constant voltage means;

the collector electrode of the third transistor is connected directly to the source of voltage, the base electrode of the third transistor is connected directly to the collector electrode of the first transistor, and the emitter electrode of the third transistor is connected to the collector electrode of the second transistor through a third resistance means; and the output terminal is connected directly to the juncture of the third resistance means and the collector electrode of the second transistor.

12. A compensated reference voltage source in accordance with claim 11 wherein the base electrode of the second transistor is connected directly to the base electrode of the first transistor; and the emitter electrodes of the first and second transistors are connected directly to each other and to the point of fixed potential.

13. A compensated reference voltage source in accordance with claim 12 wherein the constant voltage means includes a Zener diode connected across the collector and base electrodes of the first transistor; and the base-emitter characteristics of the first, second, and third transistors are essentially identical.

* * * * *